US008580091B2

(12) United States Patent
Niksa et al.

(10) Patent No.: US 8,580,091 B2
(45) Date of Patent: Nov. 12, 2013

(54) MULTI-LAYER MIXED METAL OXIDE ELECTRODE AND METHOD FOR MAKING SAME

(75) Inventors: Marilyn J. Niksa, Chardon, OH (US); Andrew J. Niksa, Chardon, OH (US)

(73) Assignee: Water Star, Inc., Newbury, OH (US)

( * ) Notice: Subject to any disclaimer, the term of this patent is extended or adjusted under 35 U.S.C. 154(b) by 232 days.

(21) Appl. No.: 13/117,373

(22) Filed: May 27, 2011

(65) Prior Publication Data

US 2012/0085571 A1 Apr. 12, 2012

Related U.S. Application Data

(60) Provisional application No. 61/391,232, filed on Oct. 8, 2010.

(51) Int. Cl.
*C25B 11/08* (2006.01)
*C25B 11/10* (2006.01)
*C25B 11/06* (2006.01)

(52) U.S. Cl.
USPC ..... 204/290.09; 204/290.03; 204/290.08; 204/290.12; 204/290.13; 204/290.14; 204/291

(58) Field of Classification Search
USPC ..... 204/290.01, 290.03, 290.08, 290.09, 204/290.12, 290.13, 290.14, 291
See application file for complete search history.

(56) References Cited

U.S. PATENT DOCUMENTS

| | | | | |
|---|---|---|---|---|
| 2,972,572 | A | 2/1961 | Cope, Jr. et al. | 205/298 |
| 3,234,110 | A | 2/1966 | Beer | 205/183 |
| 3,265,526 | A | 8/1966 | Beer | 427/229 |
| 3,267,010 | A | 8/1966 | Hans-Gerhard Creutz et al. | 205/298 |
| 3,632,498 | A | 1/1972 | Beer | 205/290.12 |
| 3,657,102 | A | 4/1972 | Keith et al. | 204/290.09 |
| 3,711,385 | A | 1/1973 | Beer | 205/474 |
| 3,711,397 | A | 1/1973 | Martinsons | 205/474 |

(Continued)

FOREIGN PATENT DOCUMENTS

| | | | |
|---|---|---|---|
| EP | 0 090 425 | 10/1987 | C25B 11/08 |
| EP | 0 495 468 | 7/1992 | C25D 3/58 |

(Continued)

OTHER PUBLICATIONS

PCT International Search Report for PCT/US00/17403, dated Nov. 15, 2000.

(Continued)

*Primary Examiner* — Bruce Bell
(74) *Attorney, Agent, or Firm* — Kusner & Jaffe

(57) ABSTRACT

A composition and method of manufacture of electrodes having controlled electrochemical activity to allow the electrodes to be designed for a variety of electro-oxidation processes. The electrodes are comprised of a compact coating deposited onto a conductive substrate, the coating being formed as multiple layers of a mixture of one or more platinum group metal oxides and one or more valve metal oxides. The formation of multiple layers allows the concentrations of platinum group metal and valve metal to be varied for each layer as desired for an application. For example, an electrode structure can be manufactured for use as an anode in electroplating processes, such that the oxidation of the organic additives in the electrolyte is markedly inhibited. Another electrode can be manufactured to operate at high anodic potentials in aqueous electrolytes to generate strong oxidants, e.g., hydrogen peroxide or ozone.

22 Claims, 3 Drawing Sheets

(56) References Cited

U.S. PATENT DOCUMENTS

| | | | | |
|---|---|---|---|---|
| 3,751,296 | A | 8/1973 | Beer | 204/290.12 |
| 3,773,554 | A | 11/1973 | Scrutton et al. | 427/126.5 |
| 3,778,307 | A | 12/1973 | Beer et al. | 427/560 |
| 3,788,968 | A | 1/1974 | Muller | 204/290.08 |
| 3,840,443 | A | 10/1974 | Beer | 205/122 |
| 3,869,312 | A | 3/1975 | Moss et al. | 427/78 |
| 3,878,083 | A | 4/1975 | De Nora et al. | 204/290.13 |
| 3,882,002 | A | 5/1975 | Cook, Jr. | 205/535 |
| 3,926,751 | A | 12/1975 | De Nora et al. | 205/560 |
| 3,933,616 | A | 1/1976 | Beer | 204/290.12 |
| 3,940,323 | A | 2/1976 | Cook, Jr. | 205/505 |
| 3,950,240 | A | 4/1976 | Cookfair et al. | 204/290.08 |
| 4,005,003 | A | 1/1977 | Popplewell et al. | 204/290.09 |
| 4,039,400 | A | 8/1977 | Hayfield | 205/171 |
| 4,086,157 | A | 4/1978 | Koziol et al. | 204/290.03 |
| 4,272,354 | A | 6/1981 | de Nora et al. | 204/290.03 |
| 4,310,391 | A | 1/1982 | Okinaka et al. | 205/266 |
| 4,411,761 | A | 10/1983 | Roos et al. | 205/290.01 |
| 4,426,262 | A | 1/1984 | Langley et al. | 205/535 |
| 4,437,948 | A | 3/1984 | Okinaka et al. | 205/292 |
| 4,469,564 | A | 9/1984 | Okinaka et al. | 205/125 |
| 4,517,068 | A | 5/1985 | Hinden et al. | 204/283 |
| 4,528,084 | A | 7/1985 | Beer et al. | 204/290.08 |
| 4,589,969 | A | 5/1986 | Yurkov et al. | 205/290.13 |
| 5,006,321 | A | 4/1991 | Dorfman et al. | 427/192 |
| 5,098,546 | A * | 3/1992 | Kawashima et al. | 204/290.09 |
| 5,156,726 | A | 10/1992 | Nakada et al. | 204/290.09 |
| 5,167,788 | A | 12/1992 | Hardee et al. | 204/242 |
| 5,262,040 | A | 11/1993 | Hardee et al. | 205/80 |
| 5,324,407 | A | 6/1994 | Ernes et al. | 204/242 |
| 5,407,556 | A | 4/1995 | Shimada et al. | 205/77 |
| 5,489,368 | A | 2/1996 | Suitsu et al. | 204/290.13 |
| 5,783,050 | A | 7/1998 | Coin et al. | 205/284 |
| 5,908,540 | A | 6/1999 | Fanti | 204/242 |
| 6,071,570 | A | 6/2000 | Hardee et al. | 205/67 |
| 6,251,254 | B1 | 6/2001 | Katoh et al. | 215/287 |
| 6,527,939 | B1 | 3/2003 | Hardee | 205/292 |
| 6,802,948 | B2 | 10/2004 | Hardee et al. | 204/290.14 |
| 7,156,962 | B2 | 1/2007 | Koizumi et al. | 205/292 |
| 7,247,229 | B2 | 7/2007 | Hardee | 205/292 |
| 7,378,005 | B2 | 5/2008 | Kaneda et al. | 204/290.13 |
| 7,494,583 | B2 | 2/2009 | Weres | 205/759 |
| 7,566,389 | B2 * | 7/2009 | Shimamune et al. | 204/290.11 |
| 7,632,535 | B2 | 12/2009 | Carlson et al. | 427/77 |
| 7,811,426 | B2 | 10/2010 | Hashimoto et al. | 204/290.13 |
| 7,815,781 | B2 * | 10/2010 | Mojana et al. | 204/290.12 |
| 2009/0288958 | A1 | 11/2009 | Sandoval et al. | 205/576 |
| 2010/0044219 | A1 | 2/2010 | Carlson et al. | 204/290.12 |
| 2010/0096260 | A1 | 4/2010 | Xie et al. | 204/290.13 |

FOREIGN PATENT DOCUMENTS

| | | | |
|---|---|---|---|
| EP | 0 538 955 | 4/1993 | C25B 11/10 |
| EP | 0 598 517 | 5/1994 | C25D 1/04 |
| EP | 0 867 527 | 3/2001 | C25B 11/10 |
| GB | 1147442 | 4/1969 | B01K 3/06 |
| GB | 1195871 | 6/1970 | B01K 3/06 |
| GB | 1 344 540 | 1/1974 | B01K 3/06 |
| GB | 2 007 712 A | 5/1979 | C25B 11/06 |
| JP | 02213470 | 3/1992 | C25B 11/04 |

OTHER PUBLICATIONS

S. Trasatti, "Physical Electrochemistry of Ceramic Oxides," Electrochimica Acta, 36(2), 225-241, (1991).

Ch. Comninellis et al., J. Electrochemical Society, 150(3), D79-D83, (2003).

* cited by examiner

MULTI-LAYER MIXED METAL OXIDE ELECTRODE AND METHOD FOR MAKING SAME

RELATED APPLICATION

This application claims the benefit of U.S. Provisional Application No. 61/391,232, filed Oct. 8, 2010, and is fully incorporated herein by reference.

FIELD OF THE INVENTION

The present invention is directed generally to electrodes and to a method of manufacture of those electrodes. The electrodes may be used for selected electro-oxidation processes, particularly those processes in which the evolution of oxygen is the anodic reaction, e.g., electroplating, electrowinning, metal recovery, water electrolysis, water treatment and the production of "functional water." An electrode of the present invention may also be used in the production of strong oxidants such as persulfates, hydrogen peroxide, ozone and hydroxy radicals in aqueous electrolytes.

BACKGROUND OF THE INVENTION

The importance of electrochemical processes such as the evolution of chlorine and the evolution of oxygen cannot be overemphasized. Chlorine evolution, one of the world's largest industrial electrochemical processes, involves the electro-oxidation of chloride ions to produce chlorine, sodium chlorate, sodium hypochlorite or hypochlorous acid, depending upon the cell design and operating conditions. Oxygen is the product of the electro-oxidation of water molecules and oxygen evolution is coupled with most of the commercially significant industrial processes occurring in aqueous electrolytes, e.g., electroplating, electrowinning, metal recovery and water electrolysis.

Since the 1970s so-called mixed metal oxide electrodes have transformed the technological and economical aspects of processes involving both oxygen evolution and chlorine evolution. A mixed metal oxide electrode includes two kinds of metal oxides, such as an oxide of a valve metal, (e.g., titanium or tantalum) and an oxide of a platinum group metal (e.g., ruthenium, iridium or platinum). Many combinations of platinum group metal oxides and valve metal oxides have been prepared and characterized, but presently it is primarily mixtures of $TiO_2$—$RuO_2$, $TiO_2$—$RuO_2$—$IrO_2$, $TiO_2$—$RuO_2$—$SnO_2$, $TiO_2$—$IrO_2$ and $Ta_2O_3$—$IrO_2$ that are used for the various commercial electrochemical processes. The commercial success realized by mixed metal oxide electrodes is largely due to their properties, i.e., good electro-catalytic properties, a high surface area, good electrical conductivity, as well as excellent chemical and mechanical stability during extended operation in aggressive environments.

Electro-catalysis is broadly defined as the ability of an electrode to influence the rate of the electrochemical reaction. This involves a physical and/or chemical interaction between the electrode surface and the electro-active species that diffuse and migrate to that electrode surface. It is this interaction, which almost exclusively involves the oxide of the platinum group metal in mixed metal oxide electrodes, that reduces the energy required to drive the reaction, effectively lowering the electrode potential and therefore the overall cell voltage. Thus, the power consumed by the electrochemical process is reduced. The high surface area of the mixed metal oxide electrode effectively lowers the applied current density and hence the electrode potential and cell voltage, again resulting in a reduction in the power consumed for the process. Similarly, the electrical conductivity of the electrode structure can be important, minimizing the resistance to current flow through the structure, i.e., reducing the ohmic overpotential which is a component of the cell voltage.

The distribution of the platinum group metal oxide in the coating affects both the electrochemical activity and the conductivity of the electrode. The valve metal oxide is essentially non-conductive, so that the electrical conductivity depends on the particles of the platinum group metal oxide, as is discussed in a review entitled "Physical Electrochemistry of Ceramic Oxides" by S. Trasatti [Electrochimica Acta, 36(2), 225-241 (1991)]. The morphology of the layer has been shown to affect its conductivity, e.g., compact layers are more conductive than "mud-cracked" layers, the latter being typical of the morphology of commercially available mixed metal oxide electrodes. Conductivity is also affected by the thermal program used in the manufacture of the electrode.

The platinum group metal oxide particles within the coating provide the electro-catalytic activity, particularly towards the oxidation of inorganic ions, such as the chloride ion, water molecules (oxygen evolution) and towards the oxidation of aliphatic and aromatic organic molecules. The porosity of commercially available mixed metal oxide electrodes and topcoated electrodes is believed to be important, allowing electro-active species easy access to the catalytic sites. U.S. Pat. No. 6,251,254 (issued Jun. 26, 2001) describes the formation of a porous layer on the surface of a coating containing iridium oxide to provide an anode for use in the electroplating of chromium from chromium OM ions. U.S. Pat. No. 7,247,229 (issued Jul. 24, 2007) describes the addition of a porous topcoat that allows water molecules access to the catalytically active layer underneath, but inhibits the diffusion of large organic molecules or large inorganic ions to those sites. This electrode is described as being useful as the anode in electroplating, electrowinning and metal recovery processes. The application of a porous topcoat over a mixed metal oxide coating is also the subject of U.S. Pat. No. 7,378,005 (issued May 27, 2008), which describes an electrode for the production of dilute aqueous solutions of ozone for disinfection and sterilization processes. In this patent, the porosity of the topcoat is developed specifically in the thermal process used in forming the topcoat, heating the coated substrate to temperatures ranging from 600° C. to 700° C. Furthermore, it is argued that the porosity obtained in this way is critically important to the generation of ozone in the electrolysis of the aqueous solutions. U.S. Pat. No. 7,156,962 (issued Jan. 2, 2007) discloses an electrode for production of ozone or active oxygen in for-treatment water by electrolysis. The electrode has an electrode catalyst surface layer formed on the surface of a conductive substrate, wherein the electrode catalyst surface layer contains a noble metal or metal oxide.

However, the porous nature of the topcoat and the generation of gas within the pores of the topcoats described in U.S. Pat. Nos. 7,247,229 and 7,378,005 can lead to mechanical instability during extended operation. The topcoat may become powdery and may be displaced from the electrode surface. Furthermore, the roughness of the surfaces of the intermediate layer and the topcoat may increase the active surface area and consequently lower the current density and therefore the potential at which the electrode operates. In the production of strong oxidants, such as hydrogen peroxide and ozone, it is believed to be more efficient to operate at the higher anodic potentials.

Recently there has been interest in the development of anodes which are less catalytic towards the oxygen evolution reaction, allowing operation at high anodic potentials in aqueous electrolytes for the production of strong oxidants, such as hydrogen peroxide and ozone. Furthermore, advanced oxidation technologies are being developed for the destruction of organic contaminants in industrial wastewater. Direct electro-oxidation using high overpotential electrodes offers a possible approach and antimony-doped tin oxide and boron-doped diamond are considered as candidate materials for this application. It is claimed that hydroxy radicals are formed at the surface of the boron-doped diamond electrode and these radicals rapidly oxidize a wide variety of organic contaminants in water. There is also evidence, presented by Comninellis et al, [J. Electrochemical Society, 150(3), D79-D83, (2003)], that recombination of the hydroxy radicals at the electrode surface results in the formation of hydrogen peroxide. Presently however, neither tin oxide nor boron-doped diamond electrodes are used commercially. It has been shown that the stability of tin oxide is limited and the large-scale manufacture of diamond coated titanium substrates has proven to be difficult and costly.

It would be advantageous to avoid the use of a topcoat by manufacturing an electrode having a coating comprised of multiple mixed metal oxide layers, wherein the concentrations of the platinum group metal and valve metal vary as the thickness of the coating increases. Furthermore, it would be advantageous to form a relatively smooth coating that is less porous than the typical mixed metal oxide coating. Such an electrode could be tailored to a specific application, be it the production of strong oxidants such as ozone or hydrogen peroxide or as an oxygen evolving anode in electroplating processes, wherein the oxidation of additives such as levelers and brighteners is effectively inhibited, or as an oxygen evolving anode in water treatment and wastewater purification processes. Moreover, it would be advantageous to manufacture such an electrode by established, large-scale, cost-effective methods. The present invention is directed to a multi-layer mixed metal oxide electrode and method for making the same that provide these and other advantages.

SUMMARY OF THE INVENTION

The present invention is directed to a variety of electrodes for electro-oxidation reactions and a method for manufacture of those electrodes. Each electrode is comprised of a conductive substrate having a coating deposited thereon. The coating is formed as a plurality of mixed metal oxide layers i.e., a mixture of one or more platinum group metal oxides (e.g., oxides of ruthenium, rhodium, palladium, osmium, iridium and platinum) and one or more valve metal oxides (e.g., oxides of tantalum, niobium, hafnium, zirconium, titanium and aluminum). The concentrations of the two types of metals in the metal oxide layers may be varied within each layer if required. The individual mixed metal oxide layers are formed by the thermal treatment of a coating of a solution including precursor(s) of a platinum group metal oxide and precursor(s) of a valve metal oxide (e.g., salt(s) of platinum group metal(s) and salt(s) of valve metal(s)) to give a compact, relatively smooth coating. The above-mentioned precursors include all salts, organic compounds and complex compounds that provide a source of the platinum group metal and the valve metal. Moreover, according to the present invention, the conductive substrate is a valve metal, such as titanium, tantalum, zirconium or niobium. The conductive substrate may take a variety of forms, such as a plate, a perforated plate, a mesh, a tubular or cylindrical structure or a rod-like structure.

The preferred method of manufacture of the electrode of the present invention is similar to that for well-known mixed metal oxide electrodes, e.g., the DSA® electrodes widely used in the electrochemical industry. The surface of the conductive substrate is degreased and cleaned before being etched or sand-blasted to give a required surface roughness. The conductive substrate is then thinly coated with a solution including precursor(s) of a platinum group metal oxide and precursors(s) of a valve metal oxide, such as salt(s) of one or more platinum group metals (e.g., $IrCl_3$) and salt(s) of one or more valve metals (e.g., $TaCl_5$). The coated substrate is dried prior to heating in an oxygen-containing atmosphere to form the respective metal oxides. The solution coating, drying and thermal processing steps are repeated for successive layers in order to form a coating comprised of multiple mixed metal oxide layers. The preferred coating is a smooth, compact coating in which the ratio of the concentration of the platinum group metal to the concentration of the valve metal decreases in a generally step-wise fashion for each of the layers from the layer adjacent to the substrate (which may be at the substrate-coating interface, e.g., if no barrier layer is used) to the layer at the electrode surface (i.e., the surface layer of the coating). The number of layers formed and the ratio of the concentration of the platinum group metal to the concentration of the valve metal in each layer depends upon the intended application.

According to the present invention there is provided an electrode, the operating potential of which in an aqueous electrolyte will approach that required for efficiently carrying out a selected electro-oxidation process, such as oxygen evolution in water electrolysis or in electroplating and metal recovery processes, or the production of strong oxidants, such as hydrogen peroxide and ozone.

In accordance with the present invention, there is provided an electrode of controlled electrocatalytic activity for electrolytic processes. The electrode is comprised of a conductive substrate and a coating formed on the conductive substrate, said coating comprised of a plurality of mixed metal oxide layers. Each of said mixed metal oxide layers includes an oxide of a platinum group metal and an oxide of a valve metal, wherein a ratio of a concentration of the platinum group metal to a concentration of the valve metal decreases such that with each subsequent mixed metal oxide layer of said plurality of mixed metal oxide layers, the further the mixed metal oxide layer is located from the conductive substrate the smaller said ratio.

In accordance with another aspect of the present invention, there is provided a method for manufacture of an electrode of controlled electrocatalytic activity for electrolytic processes wherein said electrode is comprised of a conductive substrate and a coating comprising a plurality of mixed metal oxide layers, each mixed metal oxide layer including a platinum group metal oxide and a valve metal oxide. The method is comprised of the steps of: (1) depositing a first mixed metal oxide layer of the plurality of mixed metal oxide layers onto the conductive substrate, wherein the first mixed metal oxide layer is deposited by: (a) applying one or more coats of a solution to the conductive substrate, said solution comprising precursor(s) of a platinum group metal oxide and precursors (s) of a valve metal oxide, and (b) drying and thermally treating each coat of the solution in an atmosphere containing oxygen, after applying each coat of the solution to the conductive substrate; and (2) depositing at least one successive mixed metal oxide layer of the plurality of mixed metal oxide layers onto the conductive substrate, said at least one successive mixed metal oxide layer deposited according to steps (a) and (b), wherein a ratio of a concentration of the platinum group metal to a concentration of the valve metal decreases with each successive mixed metal oxide layer of said plurality of mixed metal oxide layers, such that the further a mixed metal oxide layer of the plurality of mixed metal oxide layers is located from the conductive substrate the smaller is said ratio.

In accordance with yet another aspect of the present invention, there is provided a method for manufacture of an electrode for electrolytic processes, wherein said electrode is comprised of a conductive substrate and a coating comprising a plurality of mixed metal oxide layers that each include a platinum group metal oxide and a valve metal oxide. The method includes the steps of: depositing a plurality of mixed metal oxide layers onto the conductive substrate, wherein a first mixed metal oxide layer of said plurality of mixed metal oxide layers is deposited by applying to the conductive substrate a first solution and a second mixed metal oxide layer of said plurality of mixed metal oxide layers is deposited by subsequently applying onto the conductive substrate a second solution, the second solution having a smaller concentration ratio of platinum group metal to valve metal than does the first solution.

In accordance with still another aspect of the present invention, there is provided a method of controlling the electrocatalytic activity of an electrode for electrolytic processes, wherein said electrode has a coating comprised of a plurality of mixed metal oxide layers that are deposited onto a conductive substrate. The method includes the steps of: measuring the electrode potential of the electrode of controlled electrocatalytic activity in an aqueous solution containing 28 grams per liter of a chloride salt, at an ambient temperature and at a current density of 1 amp per square inch using a saturated calomel electrode (SCE) as the reference electrode; and adjusting the number of mixed metal oxide layers deposited onto the conductive substrate and adjusting a ratio of a concentration of a platinum group metal to a concentration of a valve metal for each mixed metal oxide layer, in order to produce a desired electrode as indicated by the measured electrode potential.

In accordance with yet another aspect of the present invention, there is provided an electrode for electrolytic processes, the electrode comprising a conductive substrate and a coating on the substrate, the coating including a plurality of mixed metal oxide layers each comprising both an oxide of a platinum group metal and an oxide of a valve metal. A ratio of a concentration of the platinum group metal to a concentration of the valve metal decreases with each subsequent mixed metal oxide layer of said plurality of mixed metal oxide layers, such that the further a mixed metal oxide layer of said plurality of mixed metal oxide layers is located from the conductive substrate the smaller is said ratio. In the present aspect, the plurality of mixed metal oxide layers consist of from three to seven of said layers.

BRIEF DESCRIPTION OF THE DRAWINGS

The invention may take physical form in certain parts and arrangement of parts, an embodiment of which will be described in detail in the specification and illustrated in the accompanying drawings which form a part hereof, and wherein.

DETAILED DESCRIPTION OF THE INVENTION

Figure 1:
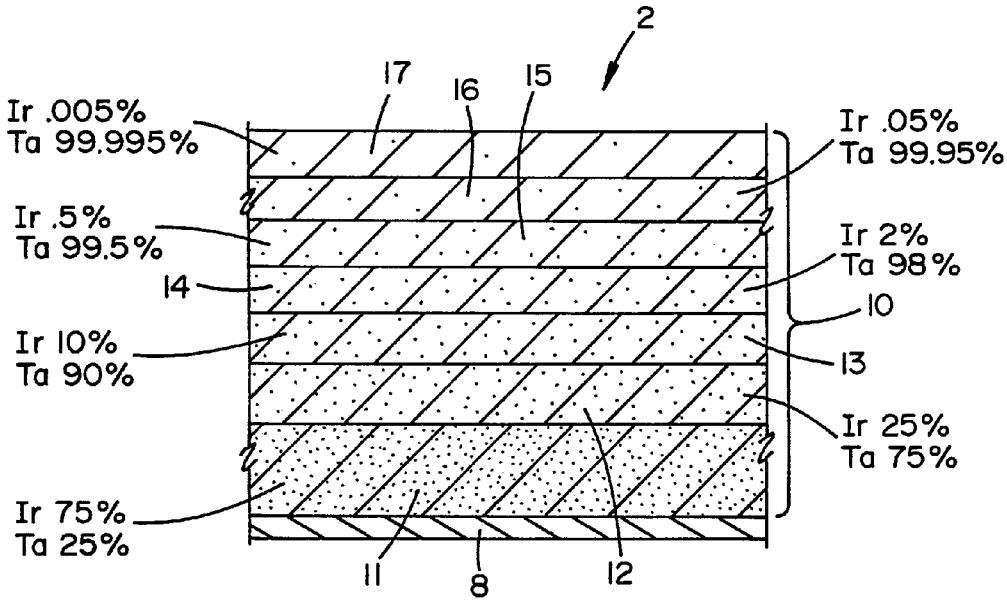
FIG. 1 illustrates a cross-sectional view of an electrode according to an embodiment of the present invention.

An embodiment of an electrode having controlled electrochemical activity that can be designed for use in a variety of electro-oxidation processes will be described hereinafter. The electrode includes a conductive substrate onto which is formed a coating comprised of a plurality of smooth, compact layers. Each layer of the plurality of layers includes a mixture of an oxide of a platinum group metal and an oxide of a valve metal. It should be understood that the number of layers of the coating may vary depending upon the application (e.g., it optionally consists of two to seven layers, three to seven layers or four to seven layers), and thus the number of layers provided in the examples discussed below are not intended to limit the scope of the present invention.

The conductive substrate is comprised of a valve metal such as titanium, tantalum, zirconium or niobium, or an alloy of two or more valve metals. Titanium is often a preferred choice for the conductive substrate, based upon its cost, availability, workability and known corrosion resistance in aggressive, aqueous environments. The conductive substrate may take many fours, including, but not limited to, a plate, a perforated plate, a mesh, a rod, a blade, a wire, and a cylindrical or tubular structure.

The plurality of layers formed on the conductive substrate provide a multi-layer coating. Each layer of the plurality of layers is comprised of a mixture of (1) an oxide of a platinum group metal (including, but not limited to, ruthenium, iridium or platinum) and (2) an oxide of a valve metal (such as titanium, tantalum, zirconium or niobium).

Each layer of the plurality of layers forming the coating may be comprised of (1) one or more platinum group metal oxides and (2) one or more valve metal oxides. Where a layer has a plurality of platinum group metal oxides, the concentration of the platinum group metal is the aggregate of the concentrations of the plurality of platinum group metals. Likewise, where a layer has a plurality of valve metal oxides, the concentration of the valve metal is the aggregate of the concentrations of the plurality of valve metals.

The ratio of the concentration of the platinum group metal to the concentration of the valve metal may be varied from layer to layer of the multi-layer coating, depending upon the intended application. According to one embodiment of the present invention, the concentration of the platinum group metal in the layers varies from 80% by weight in the layer closest to the conductive substrate to 0.0005% by weight in layer furthest from the conductive substrate (e.g., at the surface of the electrode), and the concentration of the valve metal varies from 20% by weight in the layer closest to the conductive substrate to 99.9995% in the layer furthest from the conductive substrate (e.g., at the surface of the electrode). In a preferred embodiment, the amount of platinum group metal relative to the amount of valve metal decreases in each layer of the multi-layer coating the further the layer is located from the surface of the conductive substrate. Each layer of the coating may generally have a step-wise change in the concentrations of platinum group metal and valve metal.

In the manufacture of the electrode of the invention it is to be noted that one or both surfaces of the conductive substrate may have a coating comprised of multiple layers of the mixed metal oxides. When the electrode of the invention is disposed in an electrochemical cell to face a counter electrode, i.e., in a monopolar configuration only, one surface of the conductive substrate has the coating. In a bipolar configuration, both surfaces of the conductive substrate have the coating.

The surface of the conductive substrate may be polished to remove any dirt, grease or oily deposits and any oxide films that may be present on that surface. This polishing process may involve the use of sandpaper or may be effected by blasting the surface with sand or grit particles. The polished surface is rinsed with an organic solvent such as acetone, to remove any residual organic contaminants, prior to etching in concentrated hydrochloric acid (20%) at 85-90° C. Other etching solutions, such as oxalic acid, sulfuric acid or hydrofluoric acid, may also be used to etch the surface of the conductive substrate. The etching process is continued until a predetermined surface condition (topography) is obtained.

The etched surface of the conductive substrate is coated with a thin layer of a coating solution that includes (1) a platinum group metal oxide precursor(s), e.g., salt(s) of platinum group metal(s), such as iridium chloride, i.e., $IrCl_3$, and (2) a valve metal oxide precursor(s), e.g., salt(s) of valve metal(s), such as titanium or tantalum, i.e., $TiCl_4$ or $TaCl_5$, dissolved in either water or an organic solvent such as isopropanol or n-butanol. It should be noted that the platinum group metal may be contained in an alloy, wherein the alloy may be comprised of two or more platinum group metals. Likewise, the valve metal may be contained in an alloy, wherein the alloy may be comprised of two or more valve metals.

Figure 3:
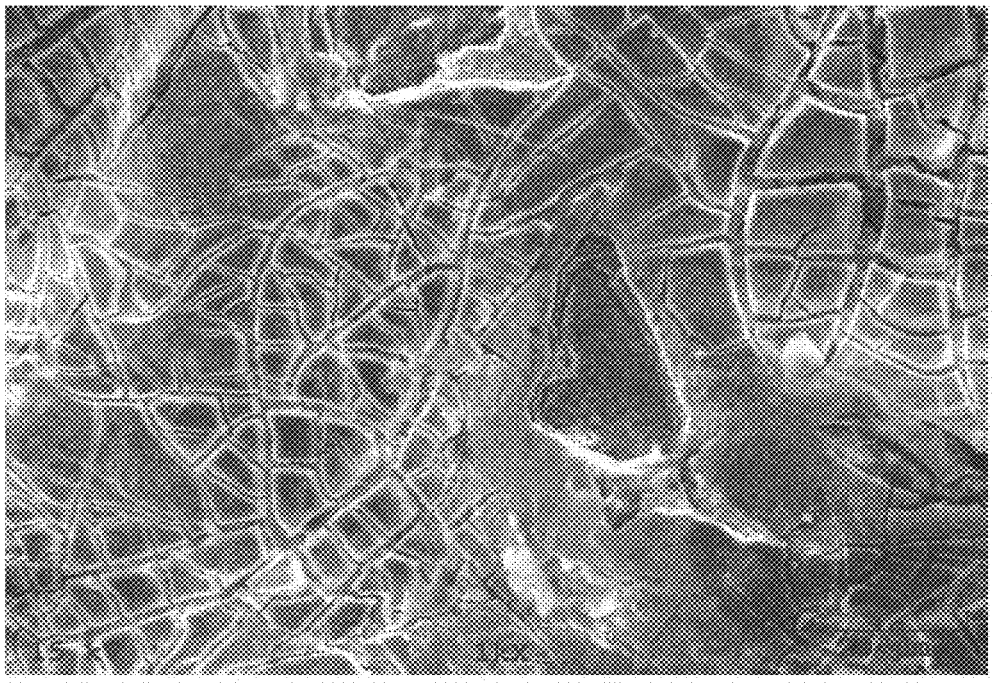
FIG. 3 shows scanning electron microscope (SEM) image of a prior art mixed metal oxide electrode (1000× magnification), the electrode having a "mud-cracked" coating.
Figure 4:
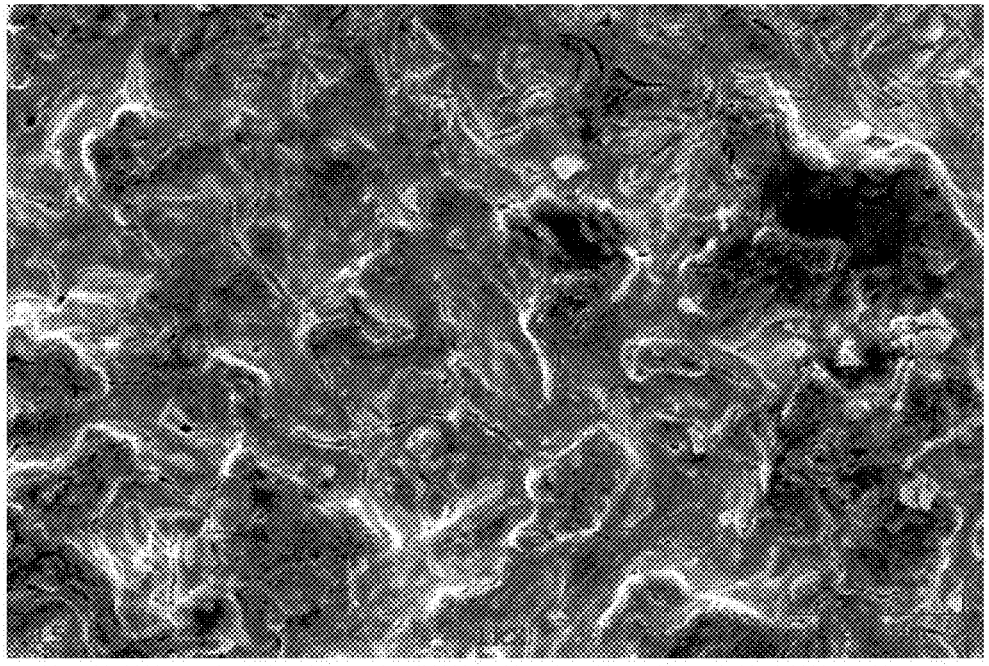
FIG. 4 shows a scanning electron microscope (SEM) image of a mixed metal oxide electrode according to an embodiment of the present invention (1000× magnification), the electrode having a compact coating.

A small amount of concentrated hydrochloric acid may be added to the coating solution, whether it is water-based or alcohol-based. It is particularly useful to coat the conductive substrate by applying a thin layer of a dilute solution including the precursors of the platinum group metal oxide and valve metal oxide (e.g., metal salts). This approach provides a uniform distribution of the metal oxide precursors in the coating and leads to a uniform distribution of the oxides in the layer after the thermal treatment. The coating according to the present invention is highly compact, more dense and more conductive than the typical mud-cracked coating found in commercial mixed metal oxide electrodes. FIG. 3 shows an SEM image of a prior art mixed metal oxide electrode having a mud-cracked surface. The prior art electrode includes a base coat of 70% iridium (by weight) and 30% tantalum (by weight), both based on metal basis. This electrode also includes ten (10) top coats of 100% tantalum oxide that are formed on top of the base coat. As can be seen from the SEM, there are a substantial number of cracks and fissures in the electrode that are required to provide electronic conductivity through the pure ceramic top coat to the electrically conductive base coat. FIG. 4 shows an SEM image of an electrode of the present invention, made generally according to Example 6 (described below). In contrast to the prior art electrode shown in FIG. 3, the electrode shown in FIG. 4 has a highly compact, dense coating with very few fissures. According to the present invention, cracks and fissures are not needed to provide electronic conductivity throughout the layers of the coating. Thus, the present coating, when viewed at 1000× magnification by SEM, preferably does not have a continuous web of pronounced cracks and fissures, but rather is a highly compact, dense coating, which can optionally be substantially free of pronounced cracks and fissures.

Any of the coating solutions described herein may be applied to the conductive substrate by any method used to apply liquids to a solid surface. Such methods include application with a brush or a roller, spray coating, dip spin and dip drain techniques, spin coating and spray coating, such as electrostatic spray coating. Moreover, combinations of these coating methods may be used, e.g., dip drain with spray application.

The coated substrate is allowed to dry at room temperature for several minutes and then heated, in an atmosphere containing oxygen, to a temperature between 150° C. and 250° C., preferably between 210° C. and 230° C., for ten minutes. A further thermal treatment is then carried out, heating the coated substrate, again in an atmosphere containing oxygen, to a temperature between 450° C. and 550° C., preferably between 480° C. and 510° C., for ten minutes to completely decompose the metal (oxide precursors (e.g., metal salts). The coating formed in this way is a smooth, compact, "homogeneous" mixture of the oxide of the platinum group metal and the oxide of the valve metal. By homogeneous, it is meant that, although the composition varies from layer to layer, within each layer of the plurality of mixed metal oxide layers the composition is homogeneous in that across the thickness of the layer the ratio of platinum group metal to valve metal remains constant (or at least substantially constant).

Avoiding higher temperatures for the thermal treatment helps to prevent the possible crystallization of the valve metal oxide, e.g., tantalum oxide, which can result in the formation of cracks and pores in the coating. The coated substrate is allowed to cool to room temperature before applying any additional coats of a solution (e.g., comprised of salts of the platinum group metal and the valve metal) to the substrate, and repeating the drying and heating steps described above for each additional coat.

The foregoing approach allows control of both the thickness of the coating and the loading (i.e., the specific amount of metal per unit area) of the platinum group metal oxide and valve metal oxide in that coating. The loading of the platinum group metal oxide, usually expressed as grams per square meter of geometric area, is readily controlled by the concentration of the platinum group metal oxide precursor (e.g., platinum group metal salt) in the coating solution and the number of coats applied to the conductive substrate. It should be noted that loading is based on the weight of the metal, irrespective of its actual form.

The concentrations of the platinum group metal and the valve metal can be varied for the different layers of the coating by using a series of different solutions for forming the layers, wherein the different solutions include different relative amounts of the platinum group metal oxide precursor(s) and the valve metal oxide precursor(s). In this regard, each solution used to deposit a successive layer (beginning with the solution for forming the layer closest to the surface of the conductive substrate) has a decreasing amount of platinum group metal oxide precursor(s) relative to the amount valve metal oxide precursor(s). By varying the concentrations of the platinum group metal and valve metal in each successive layer the electro-catalytic activity and conductivity of each layer can be controlled. Moreover, it is possible to produce compact, relatively smooth layers having superior conductivity and excellent adherence to the conductive substrate and to each other, thereby ensuring durability in extended operation. However, the coating is sufficiently porous for all of the intended applications and the use of pore forming agents is considered to be unnecessary. The introduction of cracks and pores in the coating, as described in U.S. Pat. No. 7,378,005 (issued May 27, 2008), or the use of mechanical methods to form pores are also unnecessary. In one embodiment of the present invention, loading of the platinum group metal oxide and the valve metal oxide ranges from 0.01 grams per square foot to 0.13 grams per square foot (for each layer of the plurality of mixed metal oxide layers) to limit cracking of the layers. It should be understood that the foregoing loading values are for illustrating an embodiment of the present invention and are not intended to limit same.

It is contemplated that one or more layers deposited onto the conductive substrate may also contain tin oxide, in addition to the platinum group metal oxide and the valve metal oxide. Tin oxide is typically introduced into the coating solution as stannic chloride, $SnCl_4$, or as stannous sulfate, $SnSO_4$ or other suitable inorganic tin salts. The tin oxide may be used with doping agents, such as antimony or indium oxide, to enhance the conductivity of the layer.

The mixed metal oxide electro-catalytic electrodes of the present invention are prepared by applying a plurality of coats of the precious metal "paint." These paints are prepared by dissolving a platinum group metal oxide precursor (e.g., a chloride salt) and a valve metal oxide precursor (e.g., a chloride salt or soluble organometallic materials) in a liquid carrier, thereby forming a coating solution. The coating solution is homogenous or at least substantially homogenous. The liquid carrier typically takes the form of an acidic water-based or alcohol-based solution. HCl may be added to the solution to provide acidity.

The coating solution is applied to the prepared conductive substrate using a roller, paint brush, or by spraying. The electrode is then dried to remove the liquid carrier, thus leaving the platinum group metal oxide precursor and the valve metal compound on the surface. Next, the electrode is cured in an oven at the prescribed temperature and time in an atmosphere containing oxygen.

A plurality of "coats" of the coating solution are applied to form each layer to ensure that the platinum group metal oxide precursor(s) and valve metal oxide precursor(s) are generally evenly distributed across the surface of the conductive substrate. In addition, a plurality of thin coats are desirable to avoid formation of powdery deposits. Multiple thin coats result in a compact, less cracked and more durable electrode. The number of "coats" for each layer may be dictated by the desired loading (i.e., total amount of platinum group metal per unit area).

In accordance with an embodiment of the present invention, each layer of the plurality of mixed metal oxide layers is formed by applying a plurality of coats of a coating solution having the same platinum group metal to valve metal concentration ratio. However, each layer of the plurality of mixed metal oxide layers preferably has a different platinum group metal to valve metal concentration ratio than every other layer of the plurality of mixed metal oxide layers. The concentration ratio is based on the weight of the platinum group metal and the valve metal alone.

Preferably, the plurality of mixed metal oxide layers are characterized by a step-wise (or at least substantially or generally step-wise) change in the above-described concentration ratio when moving from one layer to the next. If desired, this can be the case for every interface between two contiguous layers in the coating. Furthermore, each layer of the plurality of mixed metal oxide layers can optionally be homogenous (or at least substantially homogenous).

In an embodiment where each layer of the plurality of mixed metal oxide layers is comprised of a plurality of platinum group metal oxides and a plurality of valve metal oxides, a mixture of multiple platinum group metal oxide precursors and multiple valve metal oxide precursors are "painted" onto the conductive substrate. These precursors are cured to form a mixture of various platinum group metal oxides and valve metal oxides. For example, a precursor solution containing 20 grams per liter of iridium on a metal basis and 20 grams per liter of platinum on a metal basis provides a solution having an aggregated platinum group metal concentration of 40 grams per liter. To this solution of platinum group metal salts are added 20 grams per liter of a titanium salt on a metal basis and 20 grams per liter of a tantalum salt on a metal basis, thus providing a solution having an aggregated valve metal concentration 40 grams per liter. The ratio of platinum group metal concentration to valve metal concentration in this solution is 50:50. When deposited onto the surface of the conductive substrate, the concentration ratio of the platinum group metal to the valve metal is 50:50 on a metal basis.

Referring now to FIG. 1, there is shown an electrode 2 according to an exemplary embodiment of the present invention. Illustrated electrode 2 is comprised of a conductive substrate 8 and a coating 10 having seven (7) mixed metal oxide layers 11-17, wherein each mixed metal oxide layer is comprised of an oxide of a platinum group metal (i.e., iridium) and an oxide of a valve metal (i.e., tantalum). These mixed metal oxide layers 11-17 all have different concentrations (relative to every other mixed metal oxide layer) of the platinum group metal and the valve metal, as indicated by the percentages shown in the drawing. This may be the case with any embodiment of the present disclosure. The concentration of the platinum group metal in layers 11-17 varies from 75% by weight in the layer closest to the conductive substrate (layer 11) to 0.005% by weight in the layer furthest from the conductive substrate (e.g., at the surface of the electrode), and the concentration of the valve metal varies from 25% by weight in the layer closest to the conductive substrate to 99.995% in the layer furthest from the conductive substrate (e.g., at the surface of the electrode), i.e., layer 17.

This is representative of a broader group of embodiments (wherein the coating may consist of from two to eight mixed metal oxide layers) wherein: 1) the concentration of the platinum group metal in the mixed metal oxide layer closest to the conductive substrate is greater than about 50% by weight (preferably greater than about 60%, and more preferably greater than about 70%), and 2) the concentration of the platinum group metal in the mixed metal oxide layer furthest from the conductive substrate (which may be the exposed outermost layer of the coating) is less than about 10% by weight (preferably less than about 5%, and more preferably less than about 1%). In these embodiments, the concentration of the valve metal in the mixed metal oxide layer closest to the conductive substrate is less than about 50% by weight (preferably less than about 40%, and more preferably less than about 30%), and the concentration of the valve metal in the mixed metal oxide layer furthest from the conductive substrate is greater than about 90% by weight (preferably greater than about 95%, and more preferably greater than about 99%). These embodiments may advantageously have substantially step-wise concentration changes at the interfaces between adjacent mixed metal oxide layers, and/or each mixed metal oxide layer may be substantially homogenous. In some of these embodiments, the coating may be comprised of at least three (or at least four) mixed metal oxide layers of the type described above. Additionally or alternatively, the loading can be within the range noted above. In certain exemplary embodiments of the present embodiment, the platinum group metal comprises iridium and the valve metal comprises tantalum.

The preparation of an electrode of the present invention for a particular application or process can be controlled and monitored by measurement of the electrode potential. It has been found that the electrode potential, measured in a solution containing chloride ions at a concentration of approximately 30 grams per liter, (i.e., where the primary anodic reaction should be the oxidation of the chloride ions to chlorine)

correlates closely with the required performance of the electrode when oxygen evolution is the dominant anodic process. It is believed that the compact coating limits access of the chloride ions to the active sites in the coating, inhibiting the formation of chlorine.

To illustrate the ability to control the electrochemical activity (as indicated by the electrode potential), a reference electrode and a series of twelve test electrodes were prepared (see Table 1 below). The reference electrode was prepared by the methods used for commercially available mixed metal oxide electrodes. The twelve test electrodes were prepared according to the process of the present invention to provide a compact multi-layer coating with concentrations of the platinum group metal and the valve metal varying for each layer. The preparation of the reference electrode and examples of some of the reference electrodes having controlled electrochemical activity are described in detail below:

EXAMPLE 1

A mixed metal oxide electrode was prepared according to the teachings of Henri Beer in two British Patents, 1,147,442 (1965) and 1,195,871 (1967) and this coating is intended to provide a reference for comparison with the following examples of electrodes prepared according to the present invention. In a solution containing 28 grams per liter of sodium chloride, the single electrode potential (SEP) at ambient temperatures and at a current density of 1 amp per square inch is 1.1 volts versus a saturated calomel electrode. Example 1 electrode is identified as Anode No. 1 in Table 1 set forth below.

EXAMPLE 2

A mixed metal oxide electrode with controlled electrochemical activity was prepared according to the process of the present invention. Iridium trichloride and tantalum pentachloride were dissolved in n-butanol to obtain three individual coating solutions having the following platinum group metal and valve metal concentrations (based on the weights of the metals):

| Layer No. | Number of Coats Per Layer | % Iridium | % Tantalum |
|---|---|---|---|
| 1 | 4 | 75 | 25 |
| 2 | 2 | 14 | 86 |
| 3 | 2 | 4 | 96 |

It should be noted that "Layer No. 1" refers to the layer of the coating adjacent to the surface of the conductive substrate. An etched titanium substrate was sequentially coated with multiple, thin coats of each of the three different coating solutions, with the highest concentration of iridium in the layer adjacent to the titanium conductive substrate and the lowest concentration of iridium in the surface layer. Throughout the preparation of the electrode each coat was dried, then thermally cured at a temperature between 480° C. and 510° C. for approximately 10 minutes, before an additional coat was applied. The single electrode potential (SEP) was 1.2 volts versus saturated calomel electrode and the chlorine current efficiency was 42%. Example 2 electrode is identified as Anode No. 2 in Table 1.

EXAMPLE 3

A mixed metal oxide electrode with controlled electrochemical activity was prepared by the process of the present invention, as described above for Example 2, but with coating solutions having the following iridium and tantalum concentrations (based on the weights of the metals):

| Layer No. | Number of Coats Per Layer | % Iridium | % Tantalum |
|---|---|---|---|
| 1 | 5 | 75 | 25 |
| 2 | 2 | 14 | 86 |
| 3 | 2 | 4 | 96 |
| 4 | 2 | 0.5 | 99.5 |
| 5 | 2 | .01 | 99.99 |

The single electrode potential was 1.6 volts versus standard calomel electrode and the chlorine efficiency was 29%. Example 3 electrode is identified as Anode No. 4 in Table 1.

EXAMPLE 4

A mixed metal oxide electrode having controlled electrochemical activity was prepared by the process of the present invention, as described above for Examples 2 and 3, but with coating solutions having the following tantalum and iridium concentrations (based on the weights of the metals):

| Layer No. | Number of Coats Per Layer | % Iridium | % Tantalum |
|---|---|---|---|
| 1 | 5 | 75 | 25 |
| 2 | 2 | 14 | 86 |
| 3 | 2 | 4 | 96 |
| 4 | 2 | 0.5 | 99.5 |

The single electrode potential was 2.4 volts versus saturated calomel electrode and the chlorine efficiency was 23%. Example 4 electrode is identified as Anode No. 9 in Table 1.

EXAMPLE 5

A mixed metal oxide electrode having controlled electrochemical activity was prepared by the process of the present invention, as described above in Examples 2 and 3, but with coating solutions having the following tantalum and iridium concentrations (based on the weights of the metals):

| Layer No. | Number of Coats Per Layer | % iridium | % Tantalum |
|---|---|---|---|
| 1 | 5 | 75 | 25 |
| 2 | 2 | 14 | 86 |
| 3 | 2 | 4 | 96 |
| 4 | 2 | 0.5 | 99.5 |
| 5 | 15 | .01 | 99.99 |

The single electrode potential was 3.1 volts versus saturated calomel electrode and the chlorine efficiency was 16%. Ozone was measured to be 0.2 ppm. Example 5 electrode is shown as Anode No. 11 in Table 1.

EXAMPLE 6

A mixed metal oxide electrode having controlled electrochemical activity was prepared by the process of the present invention, as described above in Examples 2 and 3, but with coating solutions having the following tantalum and iridium concentrations (based on the weights of the metals):

| Layer No. | Number of Coats Per Layer | % Iridium | % Tantalum |
|---|---|---|---|
| 1 | 5 | 75 | 25 |
| 2 | 2 | 14 | 86 |
| 3 | 2 | 4 | 96 |
| 4 | 2 | 0.5 | 99.5 |
| 5 | 15 | .01 | 99.99 |
| 6 | 15 | .002 | 99.998 |

The single electrode potential was 4.3 volts versus saturated calomel electrode and the chlorine efficiency was approximately 2%. Ozone was measured at 0.6 ppm. Example 6 electrode is identified as Anode No. 13 in Table 1.

Electrode Potentials and Chlorine Efficiencies

Figure 2:
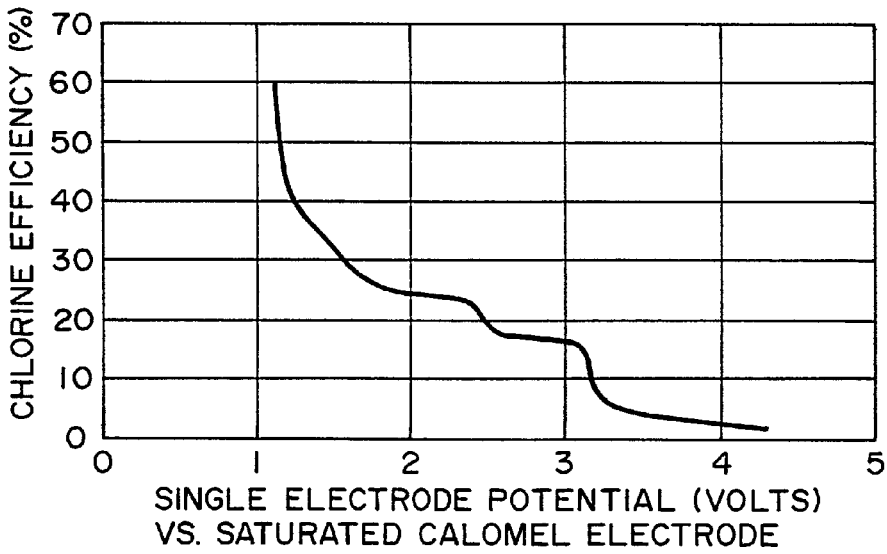
FIG. 2 is a graph illustrating chlorine efficiency (%) as a function of single electrode potential (volts) vs. saturated calomel electrode (SCE)

In addition to the example electrodes described above, seven (7) more electrodes were prepared according to the process of the present invention. Electrode potentials, chlorine efficiencies and ozone concentration values were determined for each of the electrodes, as shown in Table 1 below. The data collected in Table 1 was used to generate the graph shown in FIG. 2 illustrating chlorine efficiency as a function of single electrode potential (volts) vs. saturated calomel electrode (SCE). The electrode potentials and chlorine efficiencies for each of the electrodes were measured in an aqueous solution containing 28 grams per liter of a chloride salt (sodium chloride) at an ambient temperature (e.g., 25° C.) and at a current density of 1 amp per square inch. The surface of each anode was masked to leave an area of 1 square inch before it was installed into an electrochemical cell opposite a titanium cathode. A current of I amp was applied for 20 minutes, during which time the solution was stirred vigorously and the gases evolved were tested for the presence of ozone using a "Sensafe" test paper. The anode potential was measured with respect to a saturated calomel electrode (SCE). At the end of the test the solution was analyzed to determine the concentration of active chlorine (i.e., the combined concentrations of dissolved chlorine, hypochlorous acid and sodium hypochlorite). This analysis required the addition of potassium iodide to the sample of the electrolyte and subsequent titration of the liberated iodine with sodium thiosulfate in the presence of a starch indicator.

Referring now to Table 1 and FIG. 2, Anode No. 1 is the reference anode (Example 1). The data indicates that the oxidation of chloride ions is markedly inhibited (Anode Nos. 2-4), presumably due to (a) the compact morphology of the coating limiting the access of chloride ions to the active sites in the coating and (b) the gradation in the concentration of the platinum group metal in the layer at the surface of the electrode. As the composition of the coating is changed, the efficiency of the oxidation of chloride ions continues to slowly decline, with oxygen evolution becoming the dominant anodic reaction and the electrode potential increases. At potentials above 2.4 volts vs SCE there is a more marked change shown, with the efficiency of the oxidation of the chloride ions declining quite sharply and ultimately ozone is generated (Anode Nos. 10-13).

TABLE 1

| Anode No. | Anode Potential (volts) vs SCE | Chlorine Efficiency (%) | Ozone Concentration (ppm) |
|---|---|---|---|
| 1 | 1.1 | 60 | 0 |
| 2 | 1.2 | 42 | 0 |
| 3 | 1.5 | 32 | 0 |
| 4 | 1.6 | 29 | 0 |

TABLE 1-continued

| Anode No. | Anode Potential (volts) vs SCE | Chlorine Efficiency (%) | Ozone Concentration (ppm) |
|---|---|---|---|
| 5 | 1.7 | 27 | 0 |
| 6 | 1.8 | 26 | 0 |
| 7 | 1.9 | 25 | 0 |
| 8 | 2.3 | 24 | 0 |
| 9 | 2.4 | 23 | 0 |
| 10 | 2.6 | 18 | 0 |
| 11 | 3.1 | 16 | 0 |
| 12 | 3.3 | 6 | 0.2 |
| 13 | 4.3 | 2 | 0.6 |

In the process for manufacture of an electrode for electrolytic processes, the electrocatalytic activity of the electrode may be controlled by measuring the electrode potential of the electrode in an aqueous solution containing 28 grams per liter of a chloride salt, at an ambient temperature and at a current density of 1 amp per square inch using a saturated calomel electrode (SCE) as the reference electrode; and adjusting the number of mixed metal oxide layers deposited onto the conductive substrate and adjusting a ratio of a concentration of a platinum group metal to a concentration of a valve metal for each mixed metal oxide layer, in order to produce a desired electrode potential. The electrode potential for reduction of chlorine activity and mitigation of the destruction of organic species in the electrolyte ranges from 1.6 to 2.4 volts versus saturated calomel electrode (SCE). The electrode potential for generation of oxidizing species (e.g., ozone) is greater than 3.0 volts.

According to one embodiment of the present invention, a desired electrode potential is achieved by depositing a first layer onto a conductive substrate having a platinum group metal concentration ranging from 75% to 80% by weight and a valve metal concentration ranging from 20% to 25% by weight, and depositing one or more successive layers onto the conductive substrate having a platinum group metal concentration ranging from 80% to 0.0005% by weight and a valve metal concentration ranging from 20% to 99.9995% by weight.

If desired, this embodiment can comprise at least three such mixed metal oxide layers, or at least four such mixed metal oxide layers, although this is not required. Additionally or alternatively, this embodiment can advantageously have step-wise concentration changes at the interfaces between mixed metal oxide layers, and/or each mixed metal oxide layer may be substantially homogenous. Furthermore, the loading range noted above can be used, if so desired. In some cases, the platinum group metal is iridium and the valve metal is tantalum.

In addition to the coating as described above, the inventors also contemplate a coating according to the present invention wherein the electrode includes an optional barrier layer. This barrier layer is applied to the conductive substrate and the plurality of mixed metal oxide layers are formed thereon. Accordingly, the barrier layer is located between the conductive substrate and the plurality of mixed metal oxide layers that are described in detail above. The barrier layer may have various compositions. For example, the barrier layer may be comprised of one or more valve metal oxides (e.g., tantala), one or more platinum group metal oxide, or a pure ceramic. Accordingly, the barrier layer may not have both a valve metal and a platinum group metal.

It is further contemplated that in certain embodiments of the present invention, the coating may include one or more additional layers (not necessarily containing both a valve metal oxide and a platinum group oxide) that are positioned between and/or over layers of the plurality of mixed metal oxide layers. However, it is preferable that all layers of the plurality of mixed metal oxide layers are provided in a contiguous sequence with the outermost such layer exposed.

The foregoing description provides specific embodiments of the present invention. It should be appreciated that these embodiments are described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. An electrode of controlled electrocatalytic activity for electrolytic processes, said electrode comprising:

a conductive substrate; and a coating formed on the conductive substrate, said coating comprised of a plurality of mixed metal oxide layers, each of said mixed metal oxide layers including:

an oxide of a platinum group metal, and an oxide of a valve metal, wherein a ratio of a concentration of the platinum group metal to a concentration of the valve metal decreases such that with each subsequent mixed metal oxide layer of said plurality of mixed metal oxide layers, the further the mixed metal oxide layer is located from the conductive substrate the smaller said ratio, wherein said plurality of mixed metal oxide layers is comprised of three or more of said mixed metal oxide layers.

2. An electrode according to claim 1, wherein said plurality of mixed metal oxide layers consists of three to seven of said mixed metal oxide layers.

3. An electrode according to claim 1, wherein each of said mixed metal oxide layers includes one or more platinum group metal oxides and one or more valve metal oxides, wherein said concentration of the platinum group metal is an aggregate of the concentrations of one or more platinum group metals and said concentration of the valve metal is an aggregate of the concentrations of one or more valve metals.

4. An electrode according to claim 1, wherein each subsequent mixed metal oxide layer generally has a step-wise change in said ratio.

5. An electrode according to claim 1, wherein particles of the platinum group metal oxide provide continuous conductive pathways through said plurality of mixed metal oxide layers.

6. An electrode according to claim 1, wherein said platinum group metal is ruthenium, iridium or platinum.

7. An electrode according to claim 1, wherein said valve metal is titanium, tantalum, zirconium or niobium.

8. An electrode according to claim 1, wherein said coating further comprises a barrier layer comprised of one or more valve metal oxides.

9. An electrode according to claim 1, wherein said conductive substrate is comprised of a valve metal or an alloy of two or more valve metals.

10. An electrode according to claim 1, wherein the concentration of the platinum group metal ranges from 75% to 80% by weight and the concentration of the valve metal ranges from 20% to 25% by weight for a first mixed metal oxide layer deposited onto the conductive substrate; and the concentration of the platinum group metal ranges from 80% to 0.0005% by weight and the concentration of the valve metal ranges from 20% to 99.9995% by weight for one or more successive mixed metal oxide layers deposited onto the conductive substrate.

11. An electrode according to claim 1, wherein the coating when viewed at 1000× magnification by a scanning electron microscope is substantially free of cracks and fissures.

12. An electrode according to claim 1, where the coating is a homogeneous mixture of the oxide of the platinum group metal and the oxide of the valve metal.

13. An electrode according to claim 1, wherein loading of the platinum group metal oxide and the valve metal oxide ranges from 0.01 grams per square foot to 0.13 grams per square foot for each mixed metal oxide layer of said plurality of mixed metal oxide layers.

14. An electrode according to claim 13, wherein the concentration of the platinum group metal in the mixed metal oxide layer closest to the conductive substrate is greater than about 50% by weight, and the concentration of the platinum group metal in the mixed metal oxide layer furthest from the conductive substrate is less than about 10% by weight.

15. An electrode according to claim 1, of controlled electrocatalytic activity for electrolytic processes, said electrode comprising:

a conductive substrate; and a coating formed on the conductive substrate, said coating comprised of a plurality of mixed metal oxide layers, each of said mixed metal oxide layers including:

an oxide of a platinum group metal, and an oxide of a valve metal, wherein a ratio of a concentration of the platinum group metal to a concentration of the valve metal decreases such that with each subsequent mixed metal oxide layer of said plurality of mixed metal oxide layers, the further the mixed metal oxide layer is located from the conductive substrate the smaller said ratio wherein the platinum group metal concentration in the plurality of mixed metal oxide layers varies from 75% by weight in the mixed metal oxide layer closest to the conductive substrate to 0.0005% by weight in the mixed metal oxide layer furthest from the conductive substrate, and the valve metal concentration in the mixed metal oxide layers varies from 25% by weight in the mixed metal oxide layer closest to the conductive substrate to 99.9995% in the mixed metal oxide layer furthest from the conductive substrate.

16. An electrode for electrolytic processes, the electrode comprising a conductive substrate and a coating on the substrate, the coating including a plurality of mixed metal oxide layers each comprising both an oxide of a platinum group metal and an oxide of a valve metal, wherein a ratio of a concentration of the platinum group metal to a concentration of the valve metal decreases with each subsequent mixed metal oxide layer of said plurality of mixed metal oxide layers, such that the further a mixed metal oxide layer of said plurality of mixed metal oxide layers is located from the conductive substrate the smaller is said ratio, said plurality of mixed metal oxide layers is comprised of three or more of said mixed metal oxide layer.

17. An electrode according to claim 16, wherein said plurality of mixed metal oxide layers consists of from four to seven of said mixed metal oxide layers.

18. An electrode according to claim 16, wherein each mixed metal oxide layer of said plurality of mixed metal oxide layers has a substantially homogenous composition insofar as each such mixed metal oxide layer has a thickness across which said ratio is substantially constant.

19. An electrode according to claim 16, wherein in moving from one of said plurality of mixed metal oxide layers to the next of said plurality of mixed metal oxide layers there is a step-wise change in said ratio.

20. An electrode according to claim 16, wherein the coating further includes a barrier layer comprised of one or more valve metal oxides.

21. An electrode according to claim 16, wherein the platinum group metal is iridium and the valve metal is tantalum.

22. An electrode according to claim 16, wherein said plurality of mixed metal oxide layers consists of from three to seven of said mixed metal oxide layers.

* * * * *